US005315207A

United States Patent [19]

Hoeberechts et al.

[11] Patent Number: 5,315,207

[45] Date of Patent: May 24, 1994

[54] DEVICE FOR GENERATING ELECTRONS, AND DISPLAY DEVICE

[75] Inventors: Arthur M. E. Hoeberechts; Nicolaas Lambert; Gerardus G. P. Van Gorkom, all of Eindhoven, Netherlands

[73] Assignee: U.S. Philips Corporation, New York, N.Y.

[21] Appl. No.: 505,308

[22] Filed: Apr. 4, 1990

[30] Foreign Application Priority Data

Apr. 28, 1989 [NL] Netherlands ..... 8901075

[51] Int. Cl.[5] ..... H01J 29/04

[52] U.S. Cl. ..... 313/444; 313/446

[58] Field of Search ..... 313/422, 444, 446

[56] References Cited

U.S. PATENT DOCUMENTS

| | | | |
|---|---|---|---|
| 4,574,216 | 3/1986 | Hoeberechts et al. | 313/446 |
| 4,717,855 | 1/1988 | Zwier et al. | 313/446 |
| 4,853,585 | 8/1989 | Hoeberechts et al. | 313/422 |
| 4,937,492 | 6/1990 | Aalders | 313/422 |

*Primary Examiner*—David K. Moore

*Attorney, Agent, or Firm*—Robert J. Kraus

[57] ABSTRACT

A planar electron-optical lens is obtained on a semiconductor cathode surface by providing an extra electrode (16) around the gate electrode (14). Dependent on the applied voltage, this configuration operates, for example, as a positive lens which supplies parallel beams without dispersion, suitable for thin, flat display devices. A large positioning tolerance is obtained due to the inherent magnification of the beam diameter in the semiconductor device, while a grid can be dispensed with.

13 Claims, 4 Drawing Sheets

DEVICE FOR GENERATING ELECTRONS, AND DISPLAY DEVICE

BACKGROUND OF THE INVENTION

The invention relates to a device for generating an electron beam, which device has a main surface provided with an electrically insulating layer having at least one aperture within which the electron beam is generated and having a gate electrode provided along at least the greater part of the aperture in the electrically insulating layer.

The invention also relates to a support for such devices and to a cathode ray tube and a display device provided with such a device or support.

In addition to cathode ray tubes (display tubes, camera tubes), a device of the type described may also be adapted for electrolithographic applications or electron microscopy.

Netherlands Patent Application 7905470 laid open to public inspection and herein incorporated by reference shows a cathode ray tube provided with a semiconductor device, a so-called "cold cathode". The operation of this cold cathode is based on the emission of electrons from a semiconductor body in which a pn junction is reverse biased in such a way that there is an avalanche multiplication of charge carriers. Some electrons may then acquire so much kinetic energy as is required to exceed the electron work function. These electrons are then emitted at the main surface of the semiconductor body and thus provide an electron current.

The emission of the electrons in the device is simplified by providing the semiconductor device with so-called acceleration electrodes or gate electrodes on an insulating layer located on the main surface, which electrodes leave an aperture (slit-shaped, annular, round, rectangular) in the insulating layer. To facilitate the emission of the electrons the semiconductor surface is provided, if desired, with a material decreasing the work function such as, for example, cesium.

Such "cold cathodes" may be advantageously used in thin, flat display devices as described in Netherlands Patent Application 8700486 corresponding to U.S. Pat. No. 4,853,585, in which a number of electron beams is generated in a row of juxtaposed semiconductor cathodes. In these devices an associated row of electron beams is incident on a fluorescent screen after deflection, acceleration and further electron-optical operations and causes a row of pixels to luminesce in accordance with the information which has been presented. For a conventional pixel pitch of 750 μm and, for example, a magnification of the emissive surface of approximately 30× in the electron-optical system, the positioning tolerance of the cathodes is therefore less than 10 μm because otherwise the pixels may overlap one another (assuming that all emissive surfaces are located in one and the same plane). Such a tolerance imposes very strict requirements on the assembly.

In the device described in Netherlands Patent Application 8700486 corresponding to U.S. Pat. No. 4,853,585 the main surface of the cathodes extends substantially parallel to the surface in which the electron beams substantially move. Highly energetic positive ions can only partly reach the surface of the semiconductor cathodes, so that their efficiency is prevented from rapid deterioration due to the ion bombardment. This is achieved by deflecting the electron beam through 90° by means of an electron-optical system comprising, inter alia an electron mirror.

The electron beam must be substantially parallel for a satisfactory operation of this electron mirror. Since the gate electrode usually functions as an acceleration electrode, it has a negative lens action on the beam of generated electrons. To render the beam substantially parallel, it is therefore necessary to arrange a first electrode preferably at the shortest possible distance from the cathode, which electrode has a positive lens action rendering the electron beam substantially parallel. The minimum distance at which such an electrode can be mounted (inter alia, due to the presence of bonding wires contacting the cathode) is approximately 300 μm.

This causes great problems from an assembly-technical point of view. Moreover, due to this distance it is necessary to use such high voltages for the lens action and the mirror action of the first electrode and the mirror electrode, respectively, that positive ions are also generated between the mirror electrode and the cathode so that the efficiency of the cathode may be affected by an ion bombardment.

SUMMARY OF THE INVENTION

It is an object of the invention, inter alia, to provide a device in which the positioning tolerances of the semiconductor cathodes may be considerably less stringent.

It is another object of the invention to provide a device in which the mirror electrode can be operated at such a low voltage that substantially no positive ions are generated between the cathode and this mirror electrode.

The invention is based on the recognition that this can be achieved by integrating, as it were, a part of the electron-optical system in the device for generating the electron beam.

A device according to the invention is characterized in that it has at least one extra electrode which, at least in a plan view, extends substantially completely beyond the surface of the gate electrode.

By giving the extra electrode a negative voltage with respect to the emissive surface, while the gate electrode has a positive voltage, the total device operates as a positive electron lens which produces an electron beam at a very short distance (of the order of 50 μm) from the main surface, which electron beam is directed substantially perpendicularly to the surface and which is not subject to or is hardly subject to variations of the beam diameter. The above-mentioned multiplication by a factor of 30 is thus partly realised in the electron-emissive body. This increases the positioning tolerance of the cold cathode in the above-mentioned application to approximately 50 μm, which is easily controllable from a manufacturing technical point of view. A simpler electron-optical system may also be sufficient in other applications by using a device according to the invention.

Since the gate electrode and the acceleration electrode can be manufactured in one masking step, the emission behaviour of different cathodes has a small variation, while large parts of the electron-optical system are used in common. This leads to a substantially identical beam behaviour per column of pixels, notably when using a plurality of cathodes in one semiconductor body.

Since the electron beams leave the cathode as substantially parallel beams, a first acceleration grid may be omitted and the first part of the electron-optical system (for example, the electron mirror) can be arranged at a conventional distance of approximately 600 μm, which does not lead to technical manufacturing problems. Moreover, the electron mirror can be given a low voltage so that positive ions are not generated or are hardly generated between this mirror and the cathode.

The cathode is preferably formed in a semiconductor material, such as silicon, gallium arsenic or another III-V compound. The emission mechanism does not necessarily have to be based on avalanche multiplication; field emitters, NEA cathodes, etc. are also feasible.

BRIEF DESCRIPTION OF THE DRAWING

The invention will now be described in greater detail with reference to some embodiments and the accompanying drawing figures in which.

The Figures are diagrammatic and not to scale. Corresponding elements are usually denoted by the same reference numerals. In the cross-sections semiconductor regions of the same conductivity type are shaded in the same direction.

DESCRIPTION OF THE PREFERRED EMBODIMENTS

Figure 1:
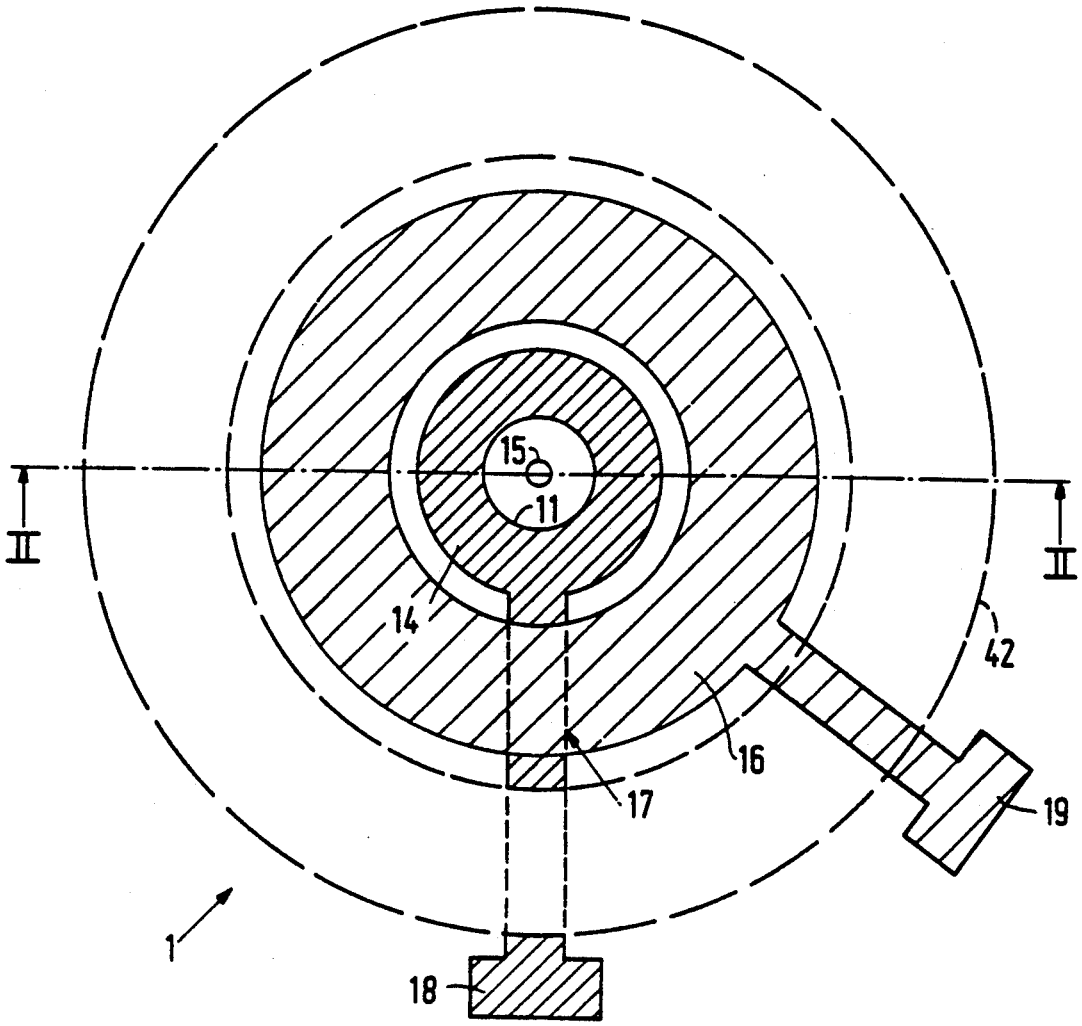
FIG. 1 is a diagrammatic plan view of a device according to the invention.
Figure 2:
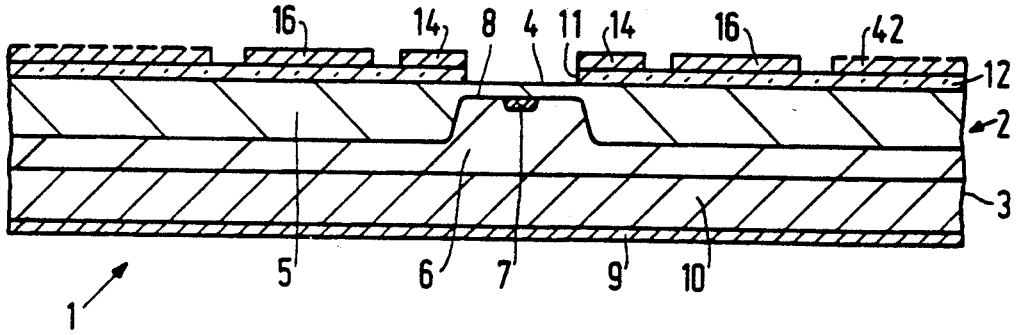
FIG. 2 is a diagrammatic cross-section taken on the line II—II in FIG. 1.

FIG. 1 is a plan view and FIG. 2 is a cross-section of a device 1 according to the invention, in this case a semiconductor cathode 2. It comprises a semiconductor body 3 which is made of silicon in this example. The semiconductor body at its main surface 4 has an n-type surface region 5 forming the pn junction 8 with the p-type regions 6 and 7. By applying a sufficiently high voltage in the reverse direction across this pn junction 8, electrons, which may be emitted from the semiconductor body, are generated by avalanche multiplication. The semiconductor device is also provided with connection electrodes (not shown) with which the n-type surface region 5 is contacted. The p-type region 7 is contacted by a metal layer 9 at the lower side in this example. This contact is preferably established via a highly doped p-type contact zone 10. In this example the donor concentration in the n-type region 5 on the surface is, for example, $5.10^{19}$ atoms/cm$^3$, while the acceptor concentration in the p-type region 6 is much lower, for example, $10^{16}$ atoms/cm$^3$. To decrease the breakdown voltage of the pn junction 8 locally, the semiconductor device is provided with a more highly doped p-type region 7 forming a pn junction with the n-type region 5. This p-type region 7 is located within an aperture 11 in a first insulating layer 12 on which a gate electrode 14 of polycrystalline silicon (polysilicon) is arranged around the aperture 11. If desired, the electron emission can be enhanced by coating the semiconductor surface within the aperture 11 with a material decreasing the work function, for example, with a layer of a material comprising barium or cesium. For further details of such a semiconductor device, also referred to as semiconductor cathode, reference is made to the above-mentioned Netherlands Patent Application 7905470.

By locally decreasing the breakdown voltage of the pn junction 8, the electron emission substantially only takes place in the circular region 15 (FIG. 1) having a diameter of approximately 3 μm.

According to the invention the device also comprises an extra electrode 16 of aluminum which completely surrounds the gate electrode 14 in this example. The electrodes 14, 16 are mutually insulated electrically at the location of the cross-under 17, for example, because the polycrystalline silicon is locally oxidized. The two electrodes may alternatively be provided in one masking step by forming them, for example, from metal and providing them after the cross-under has been provided (for example, in polycrystalline silicon) and after an electrically insulating intermediate layer and contact holes, respectively, have been provided. The electrodes 14, 16 are externally connected via the connection contacts 18, 19.

Figure 3:
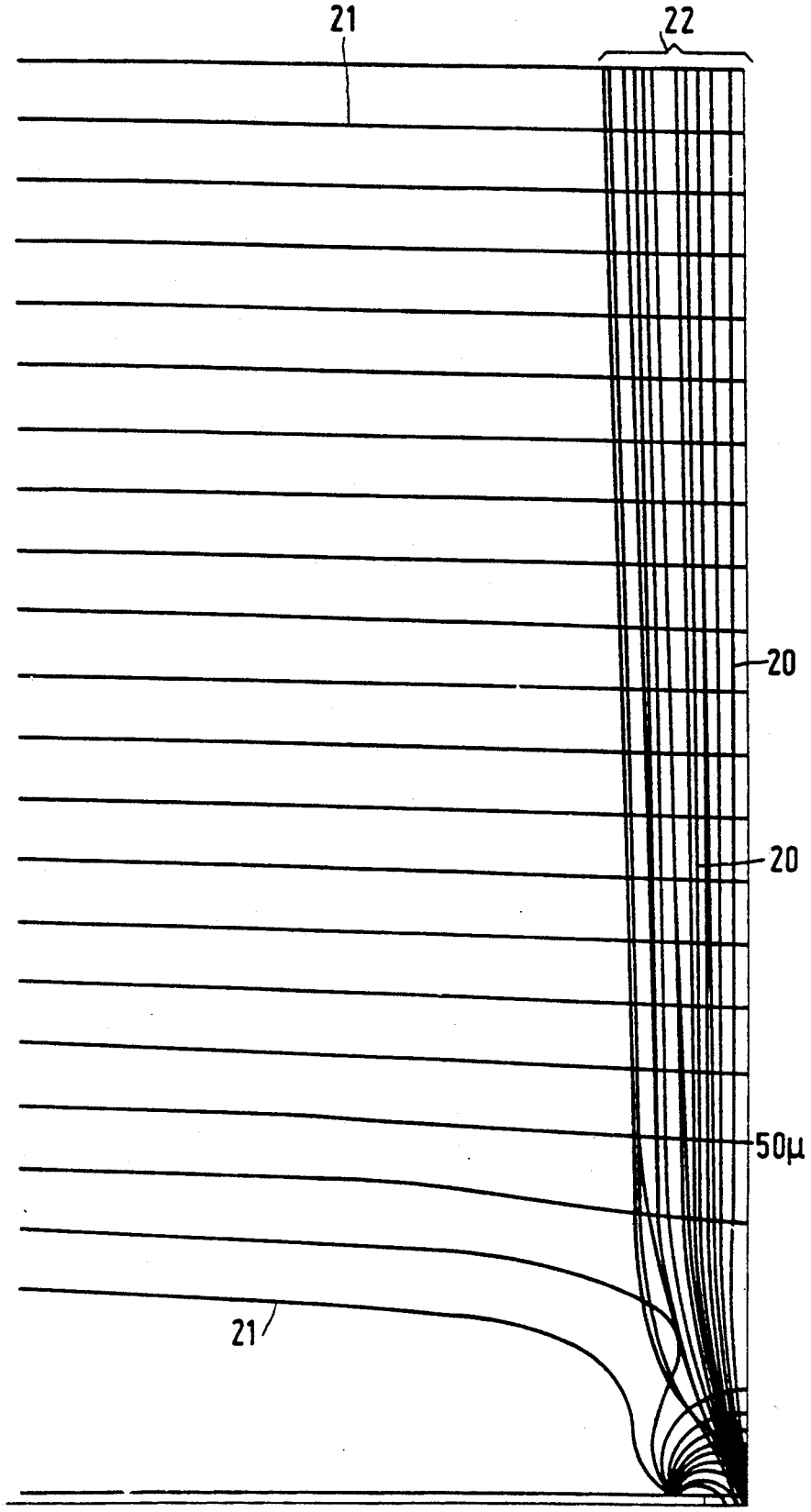
FIG. 3 shows diagrammatically a variation of the electron paths in a device according to FIGS. 1, 2.

FIG. 3 shows diagrammatically the equipotential lines 21 and the electron paths 20 in a device according to FIG. 2 when operated at a voltage of 20 V on the gate electrode 14 and a voltage of −3.2 V on the extra electrode 16. The voltage of the n-type surface region is 0 V. The aperture 11 in the insulating layer has a diameter of 10 μm in this example and the emissive surface 15 has a diameter of 3 μm. The inner diameter of the gate electrode 14 substantially coincides with the edge of the aperture 11 and the outer diameter is 22 μm, while the inner diameter of the extra electrode 16 is 26 μm and its outer diameter is 200 μm.

FIG. 3 shows that in such a cathode and at the stated voltages the associated electron paths 20 extend substantially parallel to one another in a direction perpendicular to the main surface 4 of the semiconductor body (and the emissive surface) from a distance of approximately 50 μm above this surface. The Figure also shows that the total beam has a diameter of approximately 75 μm.

By giving the extra electrode 16 a negative voltage, it is found to be possible to cause the beam to converge, as it were, at a short distance from the cathode (within 50 to 100 μm) (positive lens action) towards a beam 22 having substantially parallel electron paths 20, which beam has a substantially constant diameter in a direction perpendicular to the emissive surface. The associated magnification of such a lens is found to be a factor of approximately 6. Its advantages will be further described with reference to FIGS. 4, 5.

Figure 4:
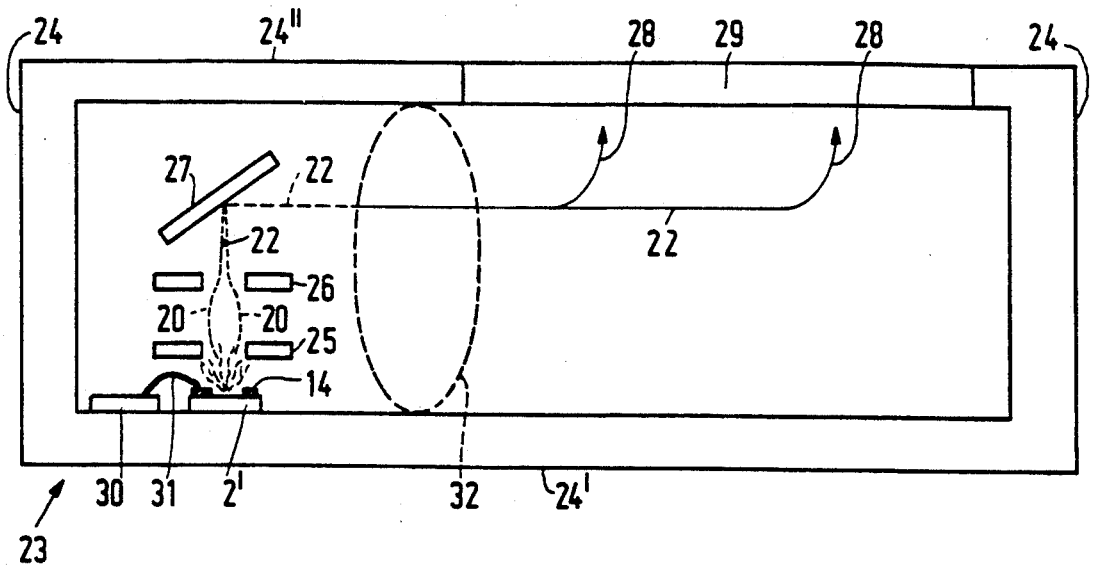
FIG. 4 PRIOR ART
FIGS. 4 and 5 show diagrammatically display devices without the extra electrode and with the extra electrode, respectively.

FIG. 4 shows a flat, thin display device 23 as described in Netherlands Patent Application 8700486 laid open to public inspection, which device has a vacuum space closed by walls 24 and accommodating a semiconductor cathode 2' for generating an electron beam. Electrons generated by this cathode are firstly accelerated by means of grids 25, 26, and after reflection on the electrode 27 they form electron beams 22 which move parallel to the rear wall 24' and the front wall 24'' of the display device 23. The beams 22 are accelerated by means of the electron-optical system 32 shown diagrammatically and, if necessary, they are focused and subsequently deflected by means of deflection electrodes (not shown) towards a fluorescent screen 29 (shown diagrammatically by means of arrows 28). The operation of such a device is further described in the Patent Application 8700486 which is herein incorporated by reference.

In order to obtain beams 22 parallel to the rear wall upon reflection on the mirror electrode 27, the electrons must be incident on this electrode at an angle of 45°, which beams comprise electrons moving along paths perpendicular to the emissive surface.

The gate electrode 14 gives the electrons emitted from the semiconductor body (in the case of a positive voltage on this electrode) an extra acceleration perpendicular to the emissive surface, but a part of the emitted electrons leaves the cathode at a given angle. To give all electrons a path substantially perpendicular to the surface, the grid 25 close to the cathode is required at a generally high voltage (approximately 40 V) while the second grid 26, also at a high voltage is required for the definitive shaping of the beam.

Due to connection wires 31 contacting, inter alia, the gate electrode 14 (for example, for signals of controlling IC's 30) the minimum distance between the cathode 2' and the grid 25 is approximately 30 μm. However, mounting at such a small distance, which is desirable for lower voltages on the grid, presents great problems. Apart therefrom these voltages and hence the voltages on the electrodes 26, 27 must be chosen so high at this distance that positive ions are generated between the cathode and the electrodes 25, 26, 27 due to ionization of residual gas particles. These positive ions are accelerated by the prevailing electric field towards the cathode which is damaged by this ion bombardment. Moreover, a number of electrons is lost because they do not pass the aperture in the first grid 25.

After deflection through 90° by means of the mirror electrode 27, the electron beams are accelerated and pass a second electron-optical system 32 (shown diagrammatically by means of broken lines).

Figure 6:
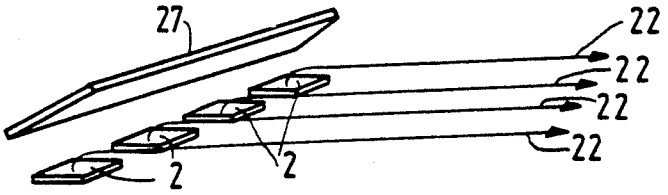
FIG. 6 shows a number of cathodes in the device according to FIG. 5.

An emissive region 15 is imaged on the luminescent screen 29 via the grids 25, 26, the mirror electrode 27 and the electron-optical system 32 after deflection (arrows 28) and the associated beam causes this screen to luminesce dependent on the adjustment of the cathode. The beam impinging on the screen 29 has a diameter which is approximately a factor of 30 larger than the diameter of the emissive surface 15. In a display system in accordance with the principle described in Netherlands Patent Application 8700486 with a plurality of juxtaposed cathodes, as is shown diagrammatically in FIG. 6 (in which only the cathodes 2, the mirror electrode 27 and the electron beams 22 are shown diagrammatically for the sake of simplicity), an alignment error of 10 μm of cathode 2 with respect to its nominal position involves a shift of approximately 300 μm of the pixel driven thereby on the fluorescent screen 29, which may lead to a blending of pixels.

Figure 5:
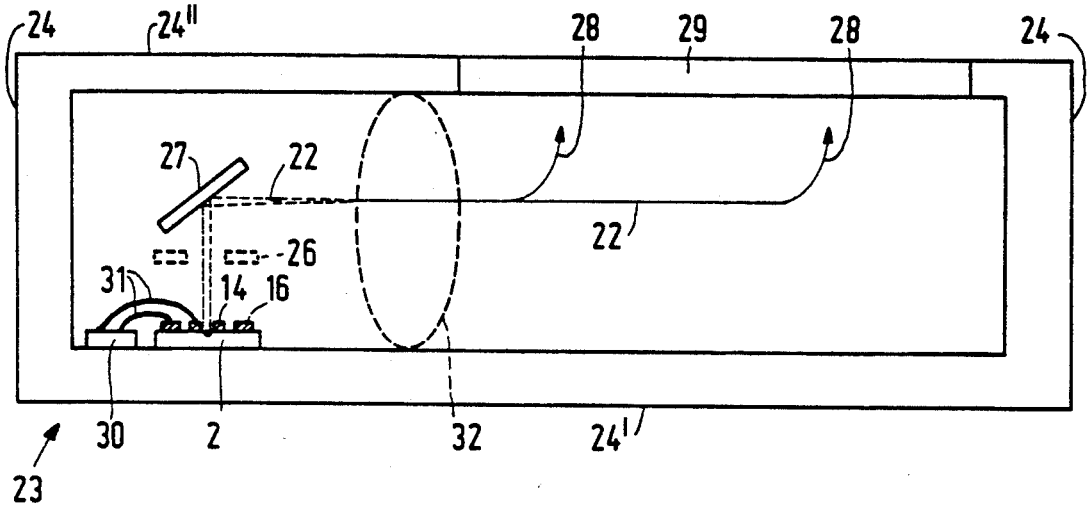

The display device 23 according to the invention, shown in FIG. 5, comprises a semiconductor cathode 2 with an extra electrode 16. As described with reference to FIGS. 1 to 3, the electron beam 22 comprises electrons from a distance of approximately 50 μm, which electrons follow paths 20 extending perpendicularly to the emissive surface and substantially parallel. Moreover, the beam diameter is approximately a factor of 6 larger than the diameter of the emissive surface 15.

Since the beams 22 now extend substantially perpendicularly to the surface 4, the grid 25 and possible also the grid 26 may be dispensed with. When using the grid 26, this grid is arranged at a distance of approximately 600 μm. From an assembly-technical point of view this distance presents fewer problems, while the voltages of the grid 26 and the mirror electrode 27 may now be sufficiently low to prevent ion generation between the electrode 27 and the surface 4.

Since the improved device immediately generates a parallel beam perpendicular to the surface with a diameter which is approximately 6 times the diameter of the emissive surface 15, a greater freedom is obtained in the arrangement of the cathodes 2. To achieve a total magnification of 30, the magnification factor of the other electron-optical system (grid 26, mirror electrode 27, electron-optical system 32) is approximately 6, which means that the positioning tolerance of the cathodes 2 may be 25 μm if the shift of pixels on the screen 29 is to be limited to at most 150 μm.

Figure 7:
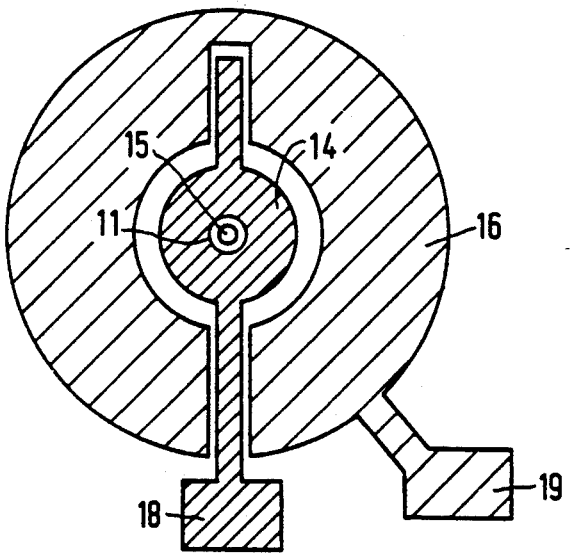
FIG. 7 shows a modification of the plan view of FIG. 1.

FIG. 7 is a diagrammatic plan view of a modification of the device of FIGS. 1, 2 in which the electrodes 14, 16 are provided in one metallization layer. The extra electrode 16 is interrupted for connection of the acceleration electrode 14. A possible asymmetry in the potential at the area of the semiconductor device can be compensated by providing the gate electrodes with one or more extra projections 45 which together with the connection track 46 have an n-digit symmetry in which, for example, n=4. However, also n=2, as in the present example, is satisfactory. Similar considerations apply to possible connection tracks for the semiconductor regions.

Figure 8:
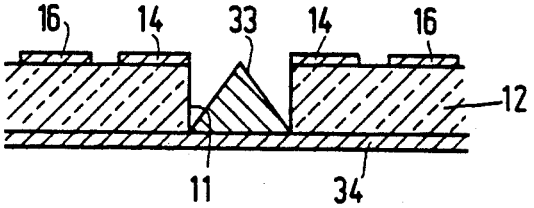
FIG. 8 shows a modification of a device according to the invention.

FIG. 8 is a cross-section of another device according to the invention in which the electrons are generated by means of field emission. To this end a field emitter 33 is present within the aperture 11 in an insulating layer 12. An (annular) gate electrode 14 is present along the edge of the (for example, round) aperture 11, which gate electrode is in its turn located within an extra electrode 16. The field emitter 33 which is contacted at its lower side via a metallization layer 3 may be implemented as a sharp metal point, for example, for use in electron tubes having only one cathode, but also for use as a semiconductor cathode as described in Netherlands Patent Application 8400297.

Figure 9:
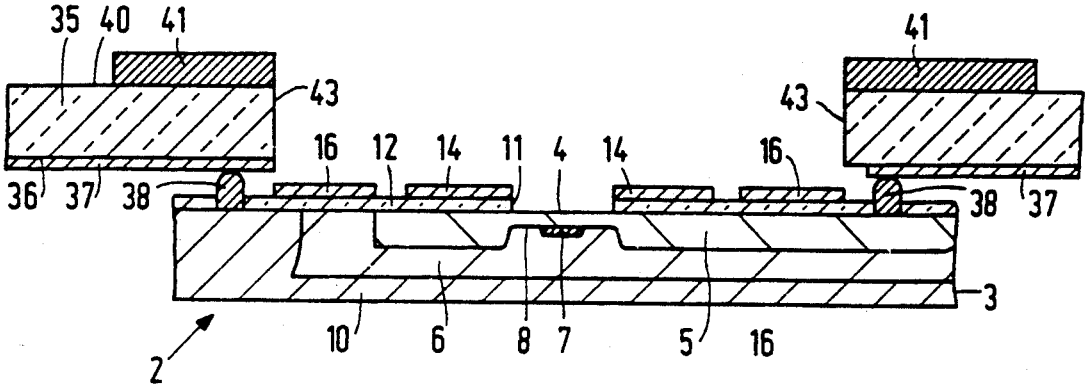
FIG. 9 shows another modification.

FIG. 9 shows a completely different device according to the invention. A support 35 of, for example, a polyimide, glass or another insulating material has one or more apertures 43 situated opposite the apertures 11 in one or more semiconductor cathodes 2. The apertures 43 leave the gate electrodes 14 and extra electrodes completely free. The support 35 has conductor tracks 37 at its lower side 36 for connecting the electrodes 14, 16 and the semiconductor regions 5, 10 in an electrically conducting manner, for example, via soldering balls 38 (by means of face-down bonding or flip-chip techniques). The connections for the electrodes 14, 16 are outside the plane of the drawing, outside the aperture 43. For contacting the p-type region 10 the device comprises a deep $p^+$ surface zone 39. Electrons generated within the aperture 11 now follow a path through the aperture 43 in the support 35. If desired, a metal electrode 41 which may form part of the electron-optical system may be arranged at the upper side 40 of the support 35.

The invention is of course not limited to the embodiments shown, but may variations which can be conceived by those skilled in the art are possible within the scope of the invention.

For example, the gate electrode may be divided into parts so as to vary the electron beam (and hence the spot shape), if desired. If necessary, the extra electrode may also be divided into two or more parts.

To obtain a possible further refinement of the electron-optical system, an electrode may be arranged around the extra electrode, which is denoted by broken lines 42 in FIGS. 1, 2.

Other emission mechanisms are alternatively possible. For example, NEA cathodes may used, but also cathodes as described in, for example U.S. Pat. Nos. 4,516,146 or 4,506,284. Instead of silicon, other materials such as gallium arsenic or other A3-B5 compounds can be used.

The shape of the aperture 11 need not be round but may alternatively be elliptic, circular or linear.

Although all examples are based on a p-type semiconductor body, an n-type semiconductor may alternatively be used (notably when realising a plurality of cathodes in one semiconductor body) for which the cathodes are formed at the area of p-type buried layers which are contacted via $p^+$ contact diffusions.

The device of FIGS. 1, 2 may also be operated at completely different voltages. By giving the gate electrode 14 a negative bias with respect to the n-type region 5 and the extra electrode 16 a positive bias, it is achieved that strongly mono-energetic electron beams are generated in the device, which is notably favourable when they are used in electron microscopy.

We claim:

1. A device for producing an electron beam comprising a substrate supporting an insulating layer having an aperture, emission means for emitting electrons through the aperture, and beam forming means for producing an electron lens for forming the emitted electrons into said electron beam, characterized in that said beam forming means comprises:

a. a first planar electrode substantially surrounding the aperture where the emitted electrons exit said aperture; and b. a second planar electrode substantially surrounding the first planar electrode.

2. A device as in claim 1 where the substrate comprises a semiconductor body and where the emission means comprises a semiconductor cathode disposed in said body in alignment with the aperture.

3. A device as in claim 2 where the insulating layer is directly supported on the substrate and where the semiconductor cathode comprises a pn junction proximate said surface and adapted for emitting said electrons by avalanche multiplication.

4. A device as in claim 2 or 3 where the semiconductor body comprises silicon or an A3-B5 compound.

5. A device as in claim 1 where the emission means comprises a field emitter which is at least partially disposed within the aperture.

6. A device as in claim 1, 2 or 5 where the aperture has a substantially circular shape.

7. A device as in claim 1, 2 or 5 where the aperture has a substantially linear shape.

8. A device as in claim 1, 2 or 5 where at least one of the electrodes comprises a plurality of subelectrodes.

9. A device as in claim 1, 2 or 5 where the insulating layer is disposed directly on the substrate.

10. A device as in claim 1, 2 or 5 where at least one of the electrodes comprise a layer disposed directly on the insulating layer.

11. A device as in claim 1, 2 or 5 where the electrodes are substantially coplanar.

12. A cathode ray display tube comprising a luminescent screen, a plurality of devices for producing respective electron beams, and means for deflecting the electron beams to a direction substantially parallel to the screen, each of said devices including a substrate supporting an insulating layer having an aperture, emission means for emitting electrons through the aperture, and beam forming means for producing an electron lens for forming the emitted electrons into said electron beam, characterized in that said beam forming means comprises:

a. a first planar electrode substantially surrounding the aperture where the emitted electrons exit said aperture; and b. a second planar electrode substantially surrounding the first planar electrode.

13. A display tube as in claim 11 where said devices are arranged for directing said beams substantially perpendicular to the direction of the screen.

* * * * *